United States Patent [19]

Hayden

[11] 4,456,896

[45] Jun. 26, 1984

[54] LOW COST RELAY

[75] Inventor: Rodney Hayden, Stoney Creek, Canada

[73] Assignee: TRW Canada Limited, Stoney Creek, Canada

[21] Appl. No.: 454,895

[22] Filed: Dec. 30, 1982

[51] Int. Cl.[3] ..... H01H 50/18

[52] U.S. Cl. ..... 335/203; 335/196

[58] Field of Search ..... 335/196, 202, 203, 204

[56] References Cited

U.S. PATENT DOCUMENTS

| | | | |
|---|---|---|---|
| 3,273,093 | 9/1966 | Hayden | 335/203 |
| 3,742,405 | 6/1973 | Hayden et al. | 335/203 |
| 4,003,011 | 1/1977 | Hayden | 335/196 |
| 4,044,322 | 8/1977 | Brown et al. | 335/133 |

OTHER PUBLICATIONS

Engineer's Relay Handbook, Mar. 28, 1974 p. 244.

*Primary Examiner*—J. D. Miller
*Assistant Examiner*—George Andrews
*Attorney, Agent, or Firm*—Daniel G. Blackhurst

[57] ABSTRACT

An improved low cost relay which comprises a one-piece spool/base, a one-piece core/terminal and a one-piece yoke/armature (yokarm). A coil wound on the spool has one of its leads led to a wire which passes through the hollow stem of the spool for contact with the core upon its insertion into the stem. The stem also retains the yokarm in position with respect to the core and spool. A contact area on the yokarm moves against a contact area on a press-fit terminal mounted in the base with excellent wiping action. The other coil lead is led to a second wire mounted in the spool, and which is captured by a lanced split in a further terminal, which is also a press-fit in the base. A suppressor diode is received in the base and has one of its leads captured by the further terminal when inserted into the base, and its other lead received and captured between the yokarm and the base when the core/terminal is inserted. A backstop for the yokarm is provided by a cover for the device which is mounted on the base.

10 Claims, 8 Drawing Figures

LOW COST RELAY

This invention relates to electromagnetic relays having particular reference to a relay assembly involving a minimum number of parts, which can be manufactured at low cost on automatic machinery without operator intervention.

Many types of relays have been made in the past and are available on the market in a wide range of sensitivities and for switching a wide range of currents. The actuating coils for such relays can be driven by alternating or direct current, the sensitivity, and the magnitude of the actuating current or applied actuating voltage, being chosen by the designer in accordance with the application to which the relay will be put.

The problem of cost has become paramount in many applications and is nowhere more vital than in the automobile and consumer appliance trade, where every small fraction of cost saving at the manufacturing level is translated into a proportionately larger saving in the finished product. Labor and material costs rise steadily and any new design which requires less labor, fewer machine operations and simpler materials is advantageous. Similarly use of less expensive components while maintaining the same or better reliability in operation, gives a cost advantage to the manufacturer and all subsequent purchasers.

Typically, a simple relay of the single pole, single throw type involves a surprisingly large number of parts; a base, a spool, a coil, a magnetic yoke, a plunger or armature or both, a spring for the armature, three terminals (two for the coil and one for the controlled load, one of the terminals for the coil supplying the power to be switched to the load terminal). Additionally, there are rivets for mounting the terminals, contacts on the terminals to be switched and where a plunger is used, a tube or guide means for it is also necessary.

The present applicant has found it possible, by a way of adopting a new approach to a core and armature structure and method of assembly, to produce a highly reliable relay which involves a minimum of parts and which may be assembled in a minimum number of automatic operations.

A relay assembly is herein described in which the magnetic core, yoke and armature may all be fabricated from commonly available material, such as sheet galvanized steel, and the mounting and electrical connections made, all on automated machinery and without soldering during assembly.

More particularly in accordance with the invention there is provided, a relay assembly which comprises:

a base and a spool including a central stem with two wires moulded in, a unitary core/terminal assembly inserted in said stem having a core portion and a terminal portion, a yoke/armature assembly secured by said core/terminal to said spool and electrically connected to the core/terminal, and a pair of additional terminals retained in said base in respective slots therein;

said yoke/armature formed from sheet magnetic material and comprising a bottom section, a side section, and an armature section connected respectively to one another at fold lines, a contact surface on said armature section;

a coil on said spool;

a pair of wires mounted in said spool, respective ends of said coil connected to said wires, one wire being taken through said central stem and engaged by said core portion and effecting direct electric connection to said terminal forming part of said core/terminal, one of said additional terminals being split and receiving the other of said wires and electrically connecting thereto, and said armature contact surface operatively cooperating with the other of said additional terminals for switching connection therewith on energizing and de-energizing of said coil. A diode may be mechanically carried in the base and electrically connected across the coil by having one of its wires led into the slot for the second of the other terminals which engages and retains it. The other of the diode wires is led adjacent the yoke-/armature and the core/terminal and is captured and electrical connection is made to it when the core/terminal is inserted into the stem.

Specific embodiments of the invention will now be described having reference to the accompanying drawings in which.

Figure 1A:
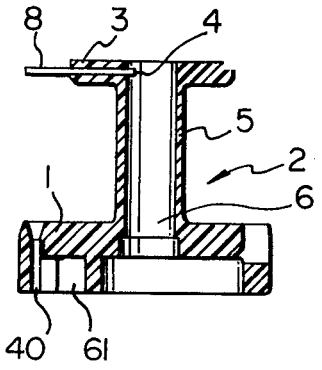
FIGS. 1A and 1B illustrate sectioned side and end views respectively of a spool and base assembly.
Figure 1B:
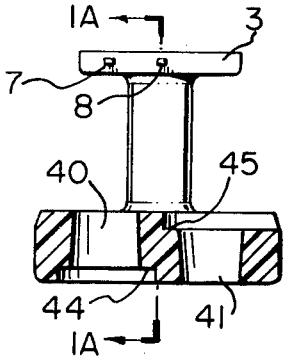

As illustrated in FIGS. 1A and 1B, a spool and base is molded in plastic in one piece and comprises a base section 1, a spool or bobbin section 2, with upper end flange 3, and a hollow stem 5. Wires 7 and 8 are molded into the upper flange 3, insulated from one another, with the inner end 4 of wire 8 extending into the hollow interior 6 or stem 5.

Figure 2:
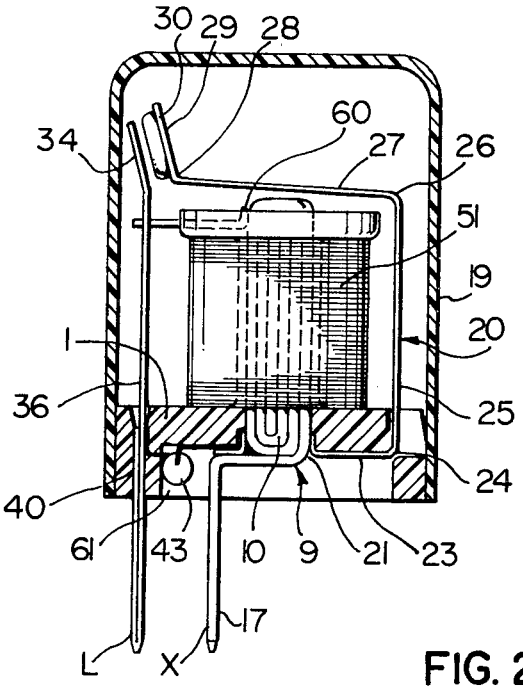
FIG. 2 is a side view partly in section of an assembled relay in a housing embodying the invention.
Figure 3:
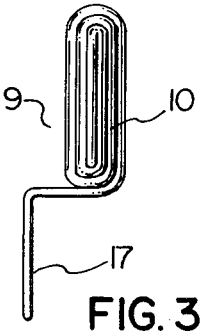
FIG. 3 is a side view of the core/terminal of FIG. 2, illustrating its method of construction.
Figure 4:
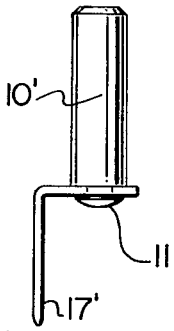
FIG. 4 is a side view of an alternative core/terminal.

Referring to FIG. 2, a core/terminal 9, (combined relay core 10 and power "X"-terminal 17) is constructed from galvanized sheet steel in a single progressive tool as one machine operation. The core 10 is made by end-for-end folding of a strip of galvanized sheet steel typically of 0.032 inch thickness and width 0.275 inch. As illustrated in FIG. 3, the terminal 17 is formed at an offset end of the strip. The essentially square portion formed by the folding action (six folds in the prototype) is cold forged to a cylindrical section to provide the core 10. While the cylindrical section is preferred for subsequent assembly steps and easier alignment, in some instances a final square or rectangular section for the core may be suitable. An alternative method of constructing the core/terminal is illustrated in FIG. 4 (though this is more expensive) and provides the core as a slug 10' of annealed steel carrying an integral pin 11 at its lower end, which can then be passed through a hole in a conventional terminal piece 17', to which it is attached by swaging the pin head.

FIG. 2 illustrates a yoke/armature (yokarm) 20 made of sheet steel typically of about 0.010 inch thickness, which is punched at 21 to form a pilot hole in its base section 23. The base section is joined at a fold line 24 to a vertical intermediate section 25, again joined at a fold line 26 to an overhead or armature leaf 27. The forward part of the armature leaf is offset at fold line 28 to provide contact support 29 on which is welded (preferably) or riveted, a contact 30 such contact being on the terminal connected to DC positive. It is also satisfactory in many instances to omit any specific contact and employ the surface of the contacting areas themselves with a silver, high electrical and heat conductivity, inlay on the surface which corresponds to the DC positive terminal. As will be explained later, with the excellent wiping action achieved by the disclosed structure, low contact resistance is obtained.

Figure 5:
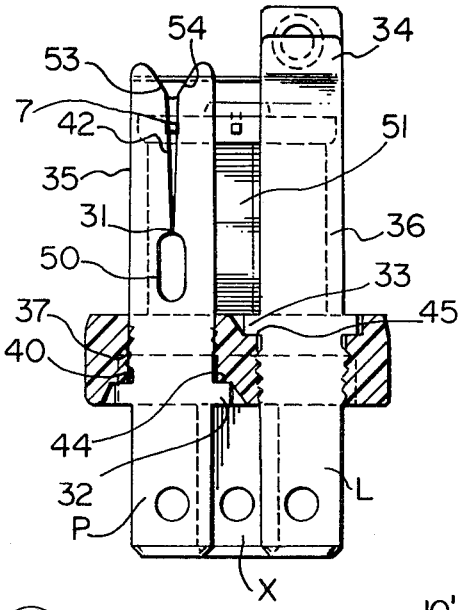
FIG. 5 is a partial end view of FIG. 2 showing two terminals arranged side-by-side, one for relay coil drive, and the second for connection to a load.

FIG. 5 illustrates a pair of terminal/connectors, which are the P- and L- terminals of relay. The P-terminal/connector 35 like the yokarm is made of sheet steel and supplies one end of an actuating winding 51 for the relay. The L-terminal/connector 36 made of half-hard brass or spring brass feeds the controlled load. Contact 30 wipes against the upper end 34 of connector 36 on actuation of the relay. The two terminals 35 and 36 are serrated or "christmas-treed" at 37 and 38, so that when pushed into the slots 40 and 41 respectively in the base 1, they are retained in position. Stop flanges 33,32 on the terminal connectors and cooperating stop faces 44,45 serve to limit penetration and accurately align the respective terminal/connectors 35,36. The terminal/-connectors are preferably constructed of strip and of thickness of 0.016 inch. The terminal ends may then be formed by single folding of the strip at such ends to a standard spade terminal thickness of 0.032 inch. This structure is particularly valuable in allowing the making of a terminal/connector from one piece, which is thin enough for good flexing but which has a standard terminal and formed as a single part.

The upper end of connector/terminal 35 is lanced at 42, and cut out at 50 to allow capturing of wire 7, as will be described later. Coining at 31 on one split side and on the rear side in a corresponding position on the other split side provides a slight initial separation of the lanced split so that wire 7 is more easily captured. A cover or housing 19 mounted on base 1 is provided for sealing and protection.

A diode 43 is received in recess 61 of base 1.

Figure 6:
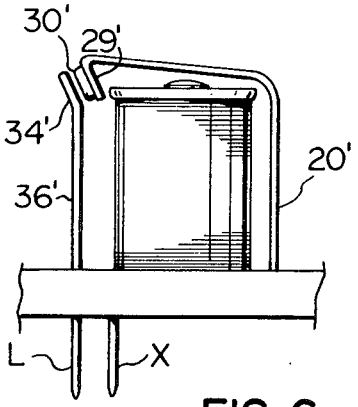
FIG. 6 shows an alternative arrangement for the relay contacts in a side view similar to FIG. 2.

FIG. 6 illustrates at 29′ and 30′, an alternative compact arrangement for the contact support 29 on the yokarm 20′, which cooperates with a shorter terminal connector 36′.

Figure 7:
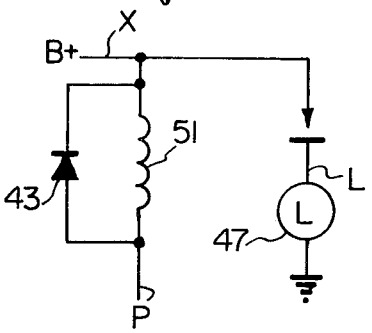
FIG. 7 shows a typical circuit for the relay connected to a source of direct current between a battery and ground.

FIG. 7 illustrates a typical circuit for this device showing the suppressor diode 43 electrically connected across the winding 51 to eliminate voltage spikes on deenergization of the winding. The terminal L feeds a load 47.

After constructing the base/spool as shown in FIGS. 1A and 1B, the spool 2 is wound with coil 51 and has its ends brought to the wires 7 and 8 to which they are soldered close to the flange 3.

The relay assembly can now take place by pushing the terminal/connector 36 down into the base 1. Next the yokarm 20 is slipped over the base/spool 2. The core/terminal 10 is then introduced from below the base 1 into the pilot hole 21 and the stem 5, and into the base 1, respectively. When the core 10 is inserted into the pilot hole contact between terminal 17 and yokarm 20 is effected by an extruding action. The extruded material from the yokarm becomes swaged between the core and the base section 1 of the spool 2. The base is recessed slightly to accommodate the swaged portion. This secures the yokarm 20 and the core/terminal in the unit. The core 10 engages and forcibly upwardly bends the inner end 4 of wire 8 (as seen at 60 in FIG. 2) thereby securely connecting one end of the coil 51 to terminal 17. The terminal/connector 35 is also introduced into the base 1 from below and engages the wire 7 at outwardly inclined ears 53,54. As 35 is pushed further into the base, wire 7 enters the lanced portion 42 where it is gripped and makes good electrical connection therefore to the other end of the coil 51. The spring action of the steel retains the connection under conditions of vibration, and under temperatures which are not so high that they alter the steel's characteristics. The terminal 35 is stopped in proper position by engagement of flanges 32 against faces 44. For best automation in assembly terminal/connector 36, rather than as illustrated in FIG. 5, may have its lower section constructed identically to that of terminal/connector 35, so that it also is inserted from below the base as just described for terminal/connector 35. The cathode lead of diode 43 is directed across the base, in a groove of depth about one-half the diameter of the lead, towards the hollow interior 6 of the stem 5. The anode lead of the diode is also taken round into a groove in a slot 41 into which the P terminal connector 35 is subsequently to be introduced. The anode lead is accommodated in such groove to a depth of about one-half its diameter. Insertion of the core 10 into the yokarm 20 and the hollow interior 6 of stem 5 therefore securely grips and makes electrical connection of the diode cathode lead to the yokarm and terminal 17. The insertion of terminal/connector 35 into slot 41 secures and electrically connects the anode lead of the diode to the P terminal.

If the relay is now actuated by the passing current through the coil between the terminals P and X, the magnetic circuit is completed through the core 10 via the lower plate 23, the intermediate side 25 and the armature 27 of the yokarm assembly 20. A very effective wiping action (typically 12 to 16 thousandths of an inch) occurs between contact 30 and 34 of connector 36 as the surface of contact 30 moves downwards and to the left as shown in the FIG. 2 or FIG. 6. The wiping action is so effective that not only is no contact needed on terminal/connector 36 but for many applications no discrete contact 30 may be required on armature support 29. A silver inlay or silver contact for heavier currents is preferably present on the contacting surface which is DC positive for best results and life due to transfer in the arc. In the prototype over 600,000 operations have been achieved with one silvered contact and without problem at 15 amps. Connector/terminal 36, of 0.016 inch thickness and one-half the thickness of its terminal end, and being half-hard or spring brass flexes to the left under pressure against its end 34. The yokarm assembly 20 is sufficiently flexible that bending occurs in the region of hinge line 24 in the side 25 and the armature 27 to allow the movement of contact support 29 and contact 30. The arrangement of FIG. 6 produces similar movement of contact 30′ against 34′. Since the flexure of the yokarm starts near the edge 24 in the embodiments of both FIG. 2 and FIG. 6, it can be seen that geometrically there is slightly less movement available for contact 30′ than for contact 30. Nevertheless, in both instances good separation in the open condition and good wiping on closing is achieved. One of the fold lines 24 or 26 can be stiffened if desired by indenting the metal at these folds, should maximum bending be preferred in one or another part of the total assembly 20, or should stiffening be desired in any region.

As FIGS. 2 and 6 both show, the ends 34 and 34' and the contacts supports 29 and 29' are offset from the perpendicular by an amount of some 5° although they are themselves substantially mutually parallel. This offset contributes to good release of the contacting surfaces when the relay is deenergized by increasing the component of movement separating the surfaces. Such offset still retains good parallel wiping of the surfaces on closing of the relay, and does not prevent the terminal/connector 36 being insertable into the base from below as described above.

The making of the yokarm as a single piece, without any specific hinge structure as employed in conventional relays, avoids hinge wear which leads to stiffness and failure of such relays to close. Hinge failures have been found to be a particularly annoying problem in the past, exacerbated when the tool forming the hinge has itself become worn during a production run. The elimination of the hinge also makes the presence of a beryllium silver shunt to carry current round the hinge unnecessary. The usual return spring is also eliminated with the one piece yokarm.

Further advantages arise if the yokarm is made of laminated steel, 0.008 inch steel/0.001 inch copper giving sufficient strength with good conductivity. The steel thickness gives good pull-in and the coppering typically allows passage of 20 amps without excess heating. The electrical conductivity of copper is about 10 times that of steel, and thus for a 40 amp relay the copper thickness may be doubled to 0.002 inch while maintaining the same 0.008 inch thickness for the steel.

The capturing and contacting action during assembly of terminal/connector 35 by way of slit 40 on wire 7 has also proved to be perfectly satisfactory without the need for any soldering. The coining at 31 and on the opposite side ensures that the split halves are initially slightly spread apart, which improves the capture characteristics.

If it is desired to construct the device so that the armature has a backstop, this may be achieved quite simply by a cover to the device, which is mounted on the base 1, the height of the cover being chosen so that it limits excessive back movement of the armature section 27 which might otherwise occur if the device is subjected to damaging force, such as by being dropped inadvertently before installation.

It can be seen further that by altering the geometry of the contact ends 34 and 29 a normally closed relay characteristic may be obtained. Thus by bending end 34 horizontal and aligning support 29 parallel to armature 27 (contact 30 then being on the reverse side of support 29), the contact surfaces will touch when the relay is released and separate when it is energized. In such a structure the terminal/connector 36 would preferably be inserted into the base from above.

Additional contacts can be located on armature 27 (such as behind support 29 as seen in FIG. 2) and additional connectors mounted in the base for engaging such contacts, all of which will be appreciated by those skilled in the art.

The relays described can be made responsive to AC by shading of the core 10 with a copper loop, as those skilled in the art will appreciate. In such instance the diode 43 would not be used. Alternatively if a further diode is placed in series with the coil 51, AC supplied to the series assembly is rectified and the relay will operate without any shading. The polarity of suppressor diode 43 with respect to the supply must of course be observed, in all instances where direct current flow through coil 51 is employed.

The embodiments of the invention in which an exclusive property or privilege is claimed are defined as follows:

1. A relay assembly which comprises:
a base and a spool including a central stem;
a unitary core/terminal assembly inserted in said stem having a core portion and a terminal portion;
a yoke/armature assembly secured to said spool and electrically connected to the core/terminal; and
a pair of additional terminals retained in said base in respective slots therein;
said yoke/armature formed from sheet magnetic material and comprising a side section, and an armature section and a bottom section connected respectively to one another at fold lines, a contact surface on said armature section;
a coil on said spool;
a pair of wires mounted in said spool, respective ends of said coil connected to said wires, one wire being taken through said central stem and engaged by said core portion and effecting direct electric connection to said terminal forming part of said core/terminal, one of said additional terminals being split and receiving the other of said wires and electrically connecting thereto, and said armature contact surface operatively cooperating with the other of said additional terminals for switching connection therewith on energizing and deenergizing of said coil.

2. Apparatus defined in claim 1 comprising diode means mechanically carried by said base and electrically connected across said coil, said diode including a pair of connecting wires and such electrical connection being effected by one of said connecting wires being led into said base slot for said one of said additional terminals and being engaged thereby, and by the other of said wires being led adjacent said yoke/armature and said core/terminal and being captured thereby by the insertion of said core/terminal in said stem.

3. Apparatus as defined in claim 1, said contact surface being oriented substantially at right angles to said armature section, and generally parallel to the cooperating other additional terminal.

4. Apparatus as defined in claim 3, said contact surface being directed downwardly with respect to said armature section towards said base.

5. Apparatus as defined in claim 1, said core/terminal assembly comprising a one piece magnetic material, said core portion being formed from the material by folding said material to predetermined thickness and subsequent shaping of such folded material.

6. Apparatus as defined in claim 1, 2 or 4 comprising a discrete contact mounted on said contact surface.

7. Apparatus as defined in claim 1, 2 or 4, said base and spool being integrally formed with one another.

8. Apparatus as defined in claim 3 wherein said contact surface and the respective contacting area of said cooperating other additional terminal are offset by a small angle towards the plane of the armature for increasing the component of mutual movement of said surface and area in the direction normal to the planes thereof when said relay is energized and deenergized.

9. Apparatus as defined in claim 8 where at least one of said contact surface and area is silvered.

10. A method of assembling a relay which comprises;

forming a base and a spool including a central stem as a single unit, forming a core/terminal as a single unit, forming a yoke/armature as a single unit from sheet magnetic material having a bottom section, a side section and an armature section connected respectively to one another with a contact surface on the armature section, inserting a pair of wires into said spool, one of said wires projecting into the central stem, winding a coil on said spool, electrically connecting said coil across said wires, inserting a pair of additional terminals into said base, one of said terminals being split and springingly engaging one of said wires for electrically connecting thereto upon its insertion into the base, inserting said core portion into said stem and through the bottom section of said yoke/armature for retaining said yoke/armature to said base and spool and electrically connecting said core/terminal to said yoke/armature, said core also engaging the end of said one wire in said central stem and effecting electrical connection thereto, said armature including a contact surface operatively cooperating with the other of said terminals for switching engagement upon energization and deenergization of said relay by passing current between said core/terminal and said first of said other terminals.

* * * * *